US010474109B2

(12) United States Patent
Legeret et al.

(10) Patent No.: US 10,474,109 B2
(45) Date of Patent: Nov. 12, 2019

(54) TIMEPIECE MOVEMENT COMPRISING A DEVICE FOR EQUALISING A MOTOR TORQUE

(71) Applicant: Montres Breguet S.A., L' Abbaye (CH)

(72) Inventors: Benoit Legeret, Ecublens (CH); Davide Sarchi, Zurich (FR)

(73) Assignee: Montres Breguet S.A., L'Abbaye (CH)

( * ) Notice: Subject to any disclaimer, the term of this patent is extended or adjusted under 35 U.S.C. 154(b) by 48 days.

(21) Appl. No.: 15/686,463

(22) Filed: Aug. 25, 2017

(65) Prior Publication Data

US 2018/0107166 A1 Apr. 19, 2018

(30) Foreign Application Priority Data

Oct. 19, 2016 (EP) ..... 16194627

(51) Int. Cl.
*G04C 5/00* (2006.01)
*G04B 1/22* (2006.01)

(52) U.S. Cl.
CPC ..... *G04C 5/005* (2013.01); *G04B 1/22* (2013.01); *G04C 5/00* (2013.01)

(58) Field of Classification Search
CPC ..... G04B 1/22; G04C 5/005; G04C 5/00
See application file for complete search history.

(56) References Cited

U.S. PATENT DOCUMENTS 161,957 A * 4/1875 Hanson ..... G04B 1/22 368/140
4,087,959 A * 5/1978 Laesser ..... G04B 19/25353 368/221
2003/0090962 A1 5/2003 Tu et al.
2010/0254229 A1* 10/2010 Kury ..... G04B 1/12 368/208

(Continued)

FOREIGN PATENT DOCUMENTS

CH 707 743 A2 9/2014
EP 2 735 919 A1 5/2014
WO WO 01/77759 A1 10/2001

OTHER PUBLICATIONS

European Search Report dated May 8, 2017 in European Application 16194627.2 filed on Oct. 19, 2016 (with English Translation of Categories of Cited Documents).

*Primary Examiner* — Daniel P Wicklund
(74) *Attorney, Agent, or Firm* — Oblon, McClelland, Maier & Neustadt, L.L.P.

(57) ABSTRACT

Timepiece movement including a mechanism, a spring barrel for driving the mechanism, and an equalization device connected to the spring barrel. The spring barrel includes a drum and a motor spring to exert a driving torque which is variable as a function of the degree of winding-up of the motor spring. The equalization device is driven by the spring barrel and exerts an auxiliary torque which varies as a function of the degree of winding-up of the motor spring to counter variations in the motor torque. The equalization device includes a first and second magnetic elements being (Continued)

displaced from each other by exerting a magnetic force which varies as a function of the relative position of the first and second magnetic elements and produces the auxiliary torque.

10 Claims, 3 Drawing Sheets

(56) References Cited

U.S. PATENT DOCUMENTS

| | | | | |
|---|---|---|---|---|
| 2012/0207001 | A1* | 8/2012 | Pittet ..... | G04B 17/30<br>368/243 |
| 2014/0146646 | A1 | 5/2014 | Goeller et al. | |
| 2017/0176938 | A1* | 6/2017 | Alagon Carrillo .... | G04B 15/10 |

* cited by examiner

TIMEPIECE MOVEMENT COMPRISING A DEVICE FOR EQUALISING A MOTOR TORQUE

This application claims priority from European Patent Application No. 16194627.2 of Oct. 19, 2016; the entire disclosure of which is incorporated herein by reference.

FIELD OF THE INVENTION

The present invention relates to a timepiece movement comprising a mechanism and a spring barrel provided in order to drive the mechanism by means of a kinematic linkage which is provided in order to exert a driving torque on the mechanism, the spring barrel comprising a drum and a motor spring provided in the drum so as to exert, on the mechanism, a motor torque which varies as a function of the degree of winding-up of the motor spring. The timepiece movement comprises furthermore an equalisation device which is connected kinematically to the spring barrel in order to be able to be driven by this spring barrel and to be able to exert an auxiliary torque which will augment said motor torque in order to form together said driving torque. The auxiliary torque is provided in order to vary as a function of the degree of winding-up of the motor spring so as to counter variations in the motor torque and thus substantially to equalise the driving torque.

PRIOR ART

Timepiece movements which comprise an equalisation device and which correspond to the above definition are already known. Devices with spindles which serve to compensate for the variation in torque provided by a spring barrel are known. Also known in particular is the "stackfreed" which is an equalisation device which was used in Germany, in the $16^{th}$ and $17^{th}$ century, in order to compensate for variations in the winding-up of the spring of a timepiece movement. In fact this concerns a braking device which is composed of a leaf spring which bears a roller at the end thereof. Said roller presses on the edge of a helical face cam, also subsequently termed spiral, which is connected kinematically to the spring barrel. When the motor spring is completely wound up, the leaf spring presses the roller firmly against the most projecting part of the spiral, and when the motor spring is less wound up, the leaf spring presses the roller less firmly against the least projecting part. As the friction force is approximately proportional to the exerted pressure, the variation thereof counters variations in the motor torque. By adjusting the profile of the cam correctly, it is possible in principle to make the motor force almost constant. A great disadvantage of the "stackfreed" is that the high degree of friction which is caused absorbs a considerable fraction of the motor force. Another disadvantage is that the leaf springs, like most other known return means, are subject to ageing and progressively lose elasticity. On the other hand, intense friction causes accelerated wear of the components. Finally, it is well known that timepiece components generally have very small dimensions. In these conditions, the fact that the springs are in general quite sensitive to tolerances constitutes an additional problem.

BRIEF EXPLANATION OF THE INVENTION

One aim of the present invention is to remedy the above-mentioned disadvantages of the prior art. The invention achieves this goal by providing a timepiece movement.

The formulation according to which the variation in auxiliary torque counters the variation in the motor torque, within a useful range of the degree of winding-up of the motor spring, amounts to saying that the derivative of the auxiliary torque relative to the degree of winding-up is of the opposite sign to the derivative of the motor torque relative to the degree of winding-up. It turns out furthermore that the derivative of the auxiliary torque relative to time is of the opposite sign to the derivative of the motor torque relative to time.

The equalisation device according to the invention comprises a first magnetic element and a second magnetic element which are provided so as to exert, one on the other, a magnetic force which is variable as a function of the relative position thereof, respectively of the degree of winding-up of the motor spring. The auxiliary torque produced by the equalisation device is caused by this variable magnetic force. In a main embodiment, at least one of said first and second magnetic elements comprises a permanent magnet. In an advantageous variant, these two magnetic elements are formed respectively by a bipolar permanent magnet and a cam made of a high-permeability magnetic material. Generally, there is understood by "magnetic cam" a magnetic element which has at least one physical parameter (radial/lateral or axial according to the case) which is active in the magnetic interaction under consideration, between the cam and another magnetic element with which it is associated, and which varies so as to cause with this other magnetic element a magnetic force between them, according to the direction of a relative displacement between the cam and the other magnetic element, the intensity of which varies as a function of this relative displacement. It will be noted that the physical parameter in question can be a parameter intrinsic to the cam, for example the intensity of a magnetic flux provided by a magnetised material forming the cam, or relative to the other magnetic element, in particular the distance between them.

The equalisation device according to the invention has several advantages. In particular, it forms a contactless system such that the variable auxiliary torque which it provides is produced without friction. Moreover, it is known that the magnetic forces which are caused by permanent magnets are conservative forces which derive from a magnetic potential. Hence, the auxiliary torque provided by the equalisation device likewise derives from a magnetic potential so that the energy dissipated by the equalisation device of the invention during a complete winding-up/unwinding cycle of the motor spring can theoretically be zero. The advantage conferred by such an equalisation device will hence be appreciated without difficulty if one keeps in mind that, in particular in a device of the "stackfreed" type, the energy provided for the auxiliary torque is dissipated integrally.

BRIEF DESCRIPTION OF THE FIGURES

Other features and advantages of the present invention will appear upon reading the description which will follow, given solely by way of non-limiting example and with reference to the annexed drawings in which.

DETAILED DESCRIPTION OF EMBODIMENTS

Figure 1A:
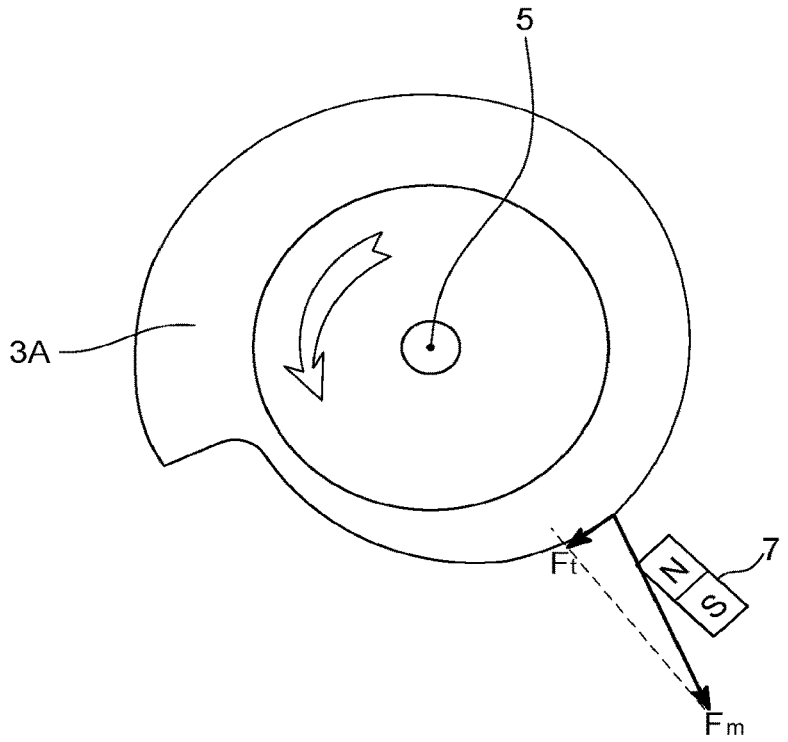
FIGS. 1A and 1B are two basic diagrams which illustrate respectively two alternative configurations of the same magnetic cam which is usable in the equalisation device of a timepiece movement according to the invention.
Figure 1B:
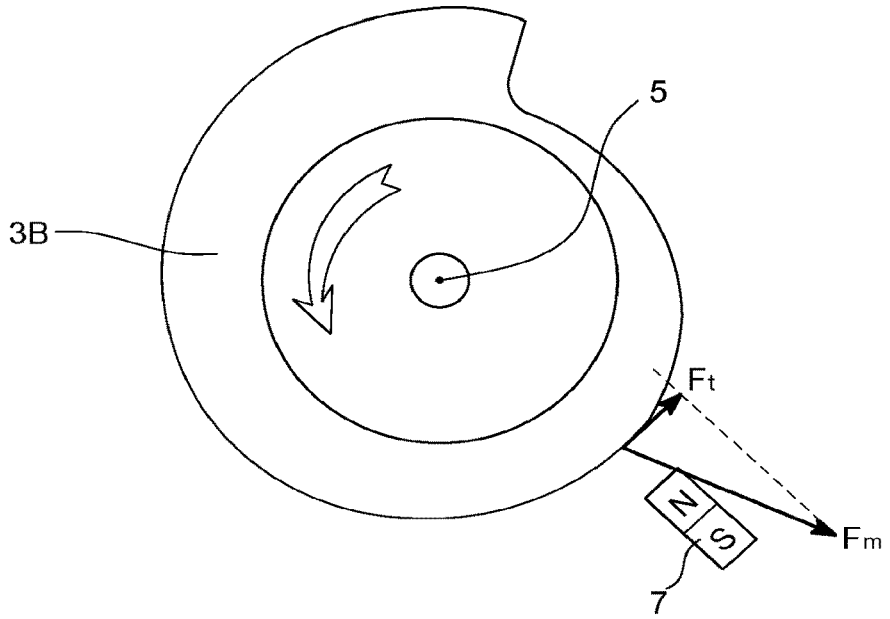

FIGS. 1A and 1B respectively illustrate two alternative arrangements of the magnetic system, formed by first and second magnetic elements, of an equalisation device according to the invention. In the two illustrated arrangements, the first and second magnetic elements respectively are a magnetic cam and a bipolar magnet. The cam is planar and it is produced in a magnetic material (for example NdFeB, SmCo or PtCo in order to form a second permanent magnet or by a ferromagnetic material). The cam 3A, respectively 3B, is provided in order to turn about an axis 5 which is perpendicular to the general plane of the cam. The bipolar magnet is mounted here fixed opposite the cam, with the north-south axis thereof orientated substantially in the direction of the axis of rotation 5.

In the examples of FIGS. 1A and 1B, the bipolar magnet 7 is provided in the same plane as the cam 3A, respectively 3B. A magnetic system of the radial type for the cam-magnet assembly is the subject here. In these examples, the cam is formed either by a magnet with substantially radial magnetisation, in the same direction as that of the bipolar magnet so that the magnetic interaction is by attraction, or by a high-permeability magnetic material which likewise causes a magnetic interaction by attraction with the bipolar magnet. In the illustrated variants, the form of the cam 3A, respectively 3B, is in a spiral, the contour opposite the bipolar fixed magnet (external contour also termed "edge" subsequently) of this cam being in a spiral (i.e. forming a turn of a geometric spiral), such that the distance between the fixed magnet and the cam varies when the latter turns about the axis 5. As a result of the spiral shape, the edge of the cam is not quite perpendicular to the radius thereof. The result is that the force of magnetic attraction (symbolised by the arrow with the reference Fm) exerted by the magnet on the cam is not orientated purely radially, this force Fm thus having a tangential component (symbolised by the arrow with the reference Ft).

The two configurations illustrated schematically in FIGS. 1A and 1B are distinguished by the direction of inclination of the edge of the cam, in other words by the direction of the spiral defined by this edge. In fact, it can be seen that, in FIG. 1A, the distance between the edge of the cam 3A and the magnet 7 increases progressively during rotation thereof in the anticlockwise direction, whilst in FIG. 1B, inversely, the distance between the edge of the cam 3B and the magnet 7 decreases progressively during rotation of the cam likewise in the anticlockwise direction. Then, the magnetic attraction force varies in intensity. By referring firstly to FIG. 1A, it can be seen that the distance between the edge of the cam and the magnet increases progressively during the above-mentioned rotation. The increase in the distance is accompanied by a concomitant decrease in the intensity of the tangential magnetic force exerted on the cam 3A by the magnet 7. It will be noted that, in a variant where the cam is formed by a magnetised material, in addition to the variation in intensity of the magnetic force due to the variation in the distance between this cam and the fixed magnet, a complementary variation in intensity can be caused by an angular variation of the intensity of the magnetic flux generated by the cam. This makes it possible to increase the tangential/angular magnetic force which causes the auxiliary torque of the equalisation device. Referring now to FIG. 1B, inversely to FIG. 1A, the decrease in the distance between the magnet and the cam is accompanied by a concomitant increase in the intensity of the magnetic force. FIG. 1A shows furthermore that the tangential component Ft of the magnetic force is counter to the direction of rotation of the cam 3A. Inversely, in FIG. 1B, the orientation of the tangential component corresponds to the direction of rotation of the cam 3B. In summary, the configuration of FIG. 1A causes a force which counters the rotation of the cam, the intensity of which decreasing with the rotation, whilst the configuration of FIG. 1B causes a force which has a direction having a same mathematical sign than the direction of rotation of the cam, the intensity of this force increasing with the rotation. In other words, the configuration of FIG. 1A causes a torque in the opposite direction to that of the rotation of the cam, whilst the configuration of FIG. 1B causes a torque in the same direction as that of the rotation of the cam.

The arrangement of the magnetic equalisation device does not necessarily comprise a magnetic system of the radial type, as illustrated in FIGS. 1A and 1B. In fact, as will be seen in more detail with the second embodiment which will be described further on with reference to FIGS. 3 to 5, the arrangement of the cam-magnet assembly can form a magnetic system of the axial type. In this case, the second magnetic element (bipolar magnet) is not arranged in the same plane as the cam, but above or below this cam so that the magnetic interaction between the magnet and the cam causes a force, the resultant of which has a main component which is parallel to the axis of rotation of the latter. It will be noted that an arrangement of the radial type or of the axial type is not always accompanied by radial, respectively axial, magnetisation of the elements of the magnetic assembly. In fact, in particular in a magnetic system of the radial type, the magnetisation axis of the cam, when the latter is formed by a magnet, can be axial. The same applies for the magnet associated with the cam.

Figure 2:
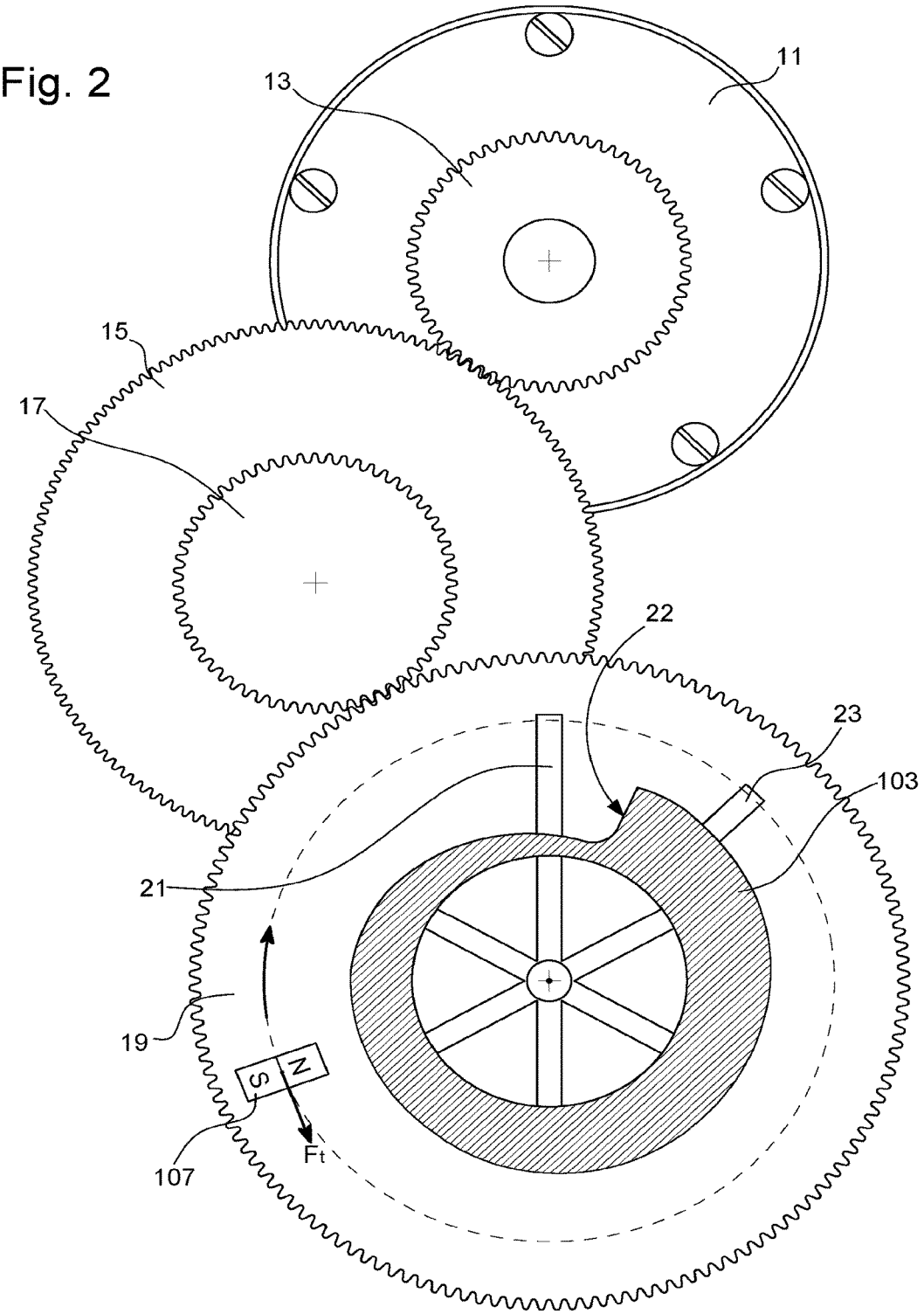
FIG. 2 is a partial plan view of a timepiece movement according to a first particular embodiment of the invention; the partial view showing the spring barrel and the equalisation device.

FIG. 2 is a partial plan view of a timepiece movement according to a first particular embodiment of the invention. The partial view illustrates only the components of the movement which are indispensable for comprehension of the invention. The other components, in particular the going train and the winding mechanism, can be conventional and are not illustrated.

The movement illustrated in FIG. 2 comprises a spring barrel 11 which comprises a pinion 13 mounted on the shaft of the spring barrel. The pinion 13 turns in the clockwise direction when the spring of the spring barrel (not illustrated) unwinds whilst driving at least one movement mechanism. As this Figure shows, the pinion 13 drives an auxiliary reducing wheel work comprising firstly a first movement formed by a wheel 15 and a pinion 17. The wheel 15 is arranged to mesh with the pinion 13 of the spring barrel, and the pinion 17 is arranged to mesh with a wheel 19. The wheel 19 bears a bipolar magnet 107 mounted on the plate thereof in an eccentric position with a radial magnetic orientation. A magnetic spiral cam 103 is arranged fixed opposite the wheel 19, concentrically to the latter. Furthermore, two radial limit stops 21 and 23 which are integral with the magnetic cam 103 are provided. The limit stops 21 and 23 are preferably produced in a non-magnetic material and are arranged on both sides of the discontinuity 22 of the edge of the cam such that the magnet 107 never moves relative to this discontinuity.

The gear ratio of the reducing wheel work which will be described is a function of the number of rotations which the spring barrel effects between the completely wound-up state thereof and the completely unwound state thereof. In fact, this ratio must be greater than the number of rotations of the spring barrel such that the angle of pivoting of the magnet 107, which is integral with the wheel 19, is always less than 360°. In other words, it is provided that the wheel 19, bearing the first magnetic element or the second magnetic element, effects at least one rotation when the spring barrel effects a plurality of rotations between the completely wound-up state thereof and the completely unwound state thereof. In the illustrated example, the spring barrel shaft effects seven rotations in order to move the spring of the spring barrel from the completely wound-up state to the completely unwound state, or inversely. On the other hand, the transmission ratio of the reducing wheel work is 8.4. In these conditions, the wheel 19 effects a little less than ⅚ of a rotation in the clockwise direction during working of the watch. It is the two limit stops 21 and 23 which determine the two extreme angular positions of the wheel 19 by stopping the magnet 107 when it reaches one or the other of the ends of its travel.

In the auxiliary reducing wheel work which has just been described, the wheel 19 turns in the same direction as the pinion of the spring barrel 13. In these conditions, the wheel 19 and the magnet 107 turn in the clockwise direction when the spring of the spring barrel (not illustrated) unwinds when driving the movement. As the variable radius of the cam 103 increases in the anticlockwise direction, there is a tangential component Ft of the magnetic attraction force between the magnet 107 and the cam 103 which acts on the mobile magnet 107 in the anticlockwise direction. Hence, when the spring of the spring barrel is run down and the wheel 19 therefore turns in the clockwise direction, a magnetic force counters this rotation. Furthermore, the intensity of the magnetic force decreases as the spring is unwound. It will be understood that the equalisation device which has just been described provides an auxiliary magnetic torque which is counter to the motor torque and the size of which decreases parallel to the size of the motor torque when the spring of the spring barrel is unwound. According to what has been explained in relation to FIGS. 1A and 1B, it will be understood furthermore that, according to an alternative variant of the first embodiment, the equalisation device could also readily provide an auxiliary magnetic torque which reinforces the motor torque, and the size of which increases as that of the motor torque decreases when the spring of the spring barrel is unwound.

According to the invention, the spring barrel of the timepiece movement is provided to drive a timepiece mechanism by means of a kinematic linkage providing a motor torque to the mechanism. In the case of a timepiece movement, the kinematic linkage which is provided to drive the timepiece mechanism generally comprises a multiplying wheel work (by way of example, the driven timepiece mechanism is an escapement with swiss pallets and the multiplying wheel work forms the going train of the timepiece movement). According to a first variant, the going train (not illustrated) is driven directly by the pinion of the spring barrel 13. In this case, it will be mentioned that the going train is arranged parallel with the equalisation device (as with a standard "stackfreed"). In another variant, a mechanism is driven by the spring barrel by means of the equalisation device. In this case, at least one part of the auxiliary wheelwork of the equalisation device forms the kinematic linkage between the spring barrel and the mechanism.

With reference again to FIG. 2, it can be seen that the drum of the spring barrel 13 does not comprise any exterior toothing. It concerns what is called a smooth spring barrel. In fact, similarly to what is known in relation to spindle movements, the present invention requires that the equalisation device be fixed angularly on the spring barrel. In other words, it is necessary that the two limit angles, defined by the limit stops 21 and 23 for the angular travel of the wheel 19, correspond respectively to the states "completely wound-up" and "completely unwound" of the spring of the spring barrel. In order to meet this restriction, in one variant where the bipolar magnet is fixed relatively to the support of the spring barrel (plate), it is provided that the winding-up and unwinding of the spring of the spring barrel both act on the same mobile part of the spring barrel. Hence, according to the example of FIG. 2, the driving of the mechanism and the winding-up of the spring barrel are both exerted by means of the pinion of the spring barrel 13, which is also coupled to the equalisation device. In a manner known per se, the winding-up can be achieved by means of a winding crown and/or by an oscillating mass. Furthermore, the winding mechanism can mesh either directly with the pinion of the spring barrel 13, or with another wheel work element downstream of the pinion of the spring barrel. However, it will be noted that, in another variant where the bipolar magnet is integral in rotation with the shaft of the spring barrel, the winding-up and unwinding of the spring barrel can be achieved respectively via the shaft and the drum of the spring barrel, or inversely.

It will be noted that the equalisation device which has just been described can also serve jointly as a device for indicating the power reserve. To this end, in a first variant, a needle is mounted on an axis of the wheel 19. In a second variant, so as to reduce the angular travel of the power reserve indicator or in particular to provide an indicator having a linear movement, a lever is connected to the cam 103. This lever defines a cam follower and is arranged abutting against the lateral surface of the cam 103. The power reserve indicator can be integral with the lever or be formed by a separate element actuated by this lever.

Figure 3:
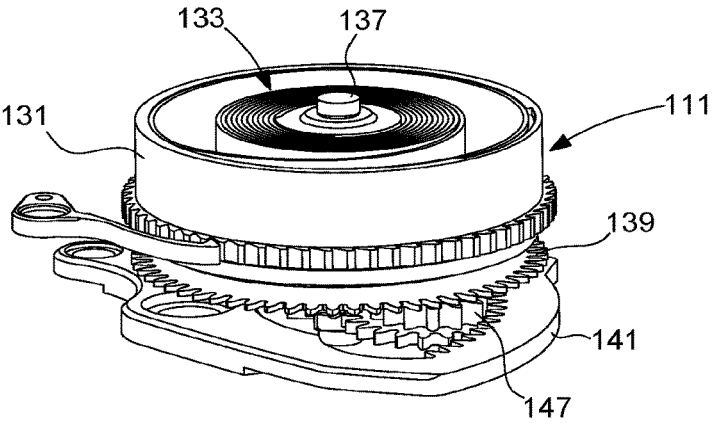
FIG. 3 is a partial perspective view on the side of a timepiece movement according to a second particular embodiment of the invention; the partial view showing the spring barrel and a part of the equalisation device.
Figure 4:
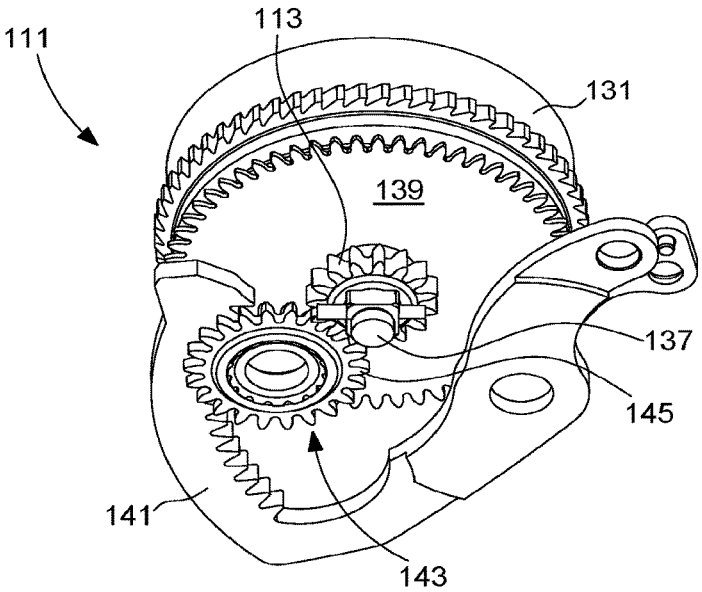
FIG. 4 is a partial perspective view from below of the timepiece movement of FIG. 3; the partial view showing the spring barrel and a part of the equalisation device.
Figure 5:
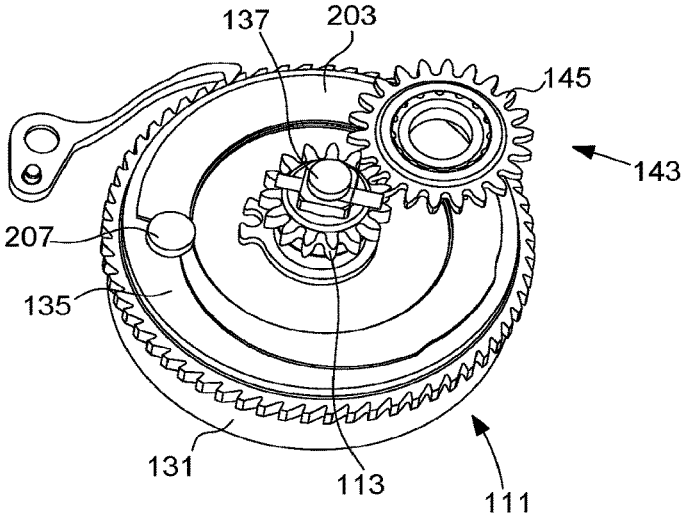
FIG. 5 is a partial perspective view from below of the spring barrel and the equalisation device of FIGS. 3 and 4; some parts having been omitted so as to allow the magnetic cam and the magnet to be shown.

The partial views of FIGS. 3 to 5 illustrate a second embodiment of the invention corresponding to a minute-repeat watch movement. The minute repetition is a ringing mechanism which is driven by a dedicated spring barrel. The ringing mechanism functions thanks to hammers which, when they are actuated, repeatedly come to strike bell springs. A particular feature of this type of mechanism is that the speed at which the ringing is performed depends upon the size of the driving torque received by the barrel spring.

With reference firstly to FIGS. 3 and 4, a spring barrel (generally with the reference 111) can be seen. The illustrated spring barrel is formed by a drum of the spring barrel 131 which serves for housing a spring 133, by a spring barrel cover 135 (shown in FIG. 5) which closes the case formed by the drum and by a spring barrel shaft 137 which passes through the spring barrel and which is pivoted by the ends thereof between the plate and a bridge (not illustrated). It can be seen again in FIG. 4 that the spring barrel shaft 137 is integral with a toothed mobile element comprising a pinion 113 and a wheel 139.

FIGS. 3 and 4 again show a winding rack 141 and a one-directional wheel work 143. One-directional wheel works are devices which are known per se. In the present example, the wheel work 143 comprises an input wheel 145 which meshes with the rack 141 and an output wheel 147 (visible in FIG. 3) which meshes with the pinion of the barrel spring 113. The toothed wheels 145 and 147 are coaxial and can pivot one relative to the other. One of these two wheels bears a coaxial ratchet (not illustrated) which is sandwiched between the input wheel and the output wheel. A pawl (not illustrated) is pivoted on the plate of the wheel which is opposite the ratchet. This pawl is locked against the circumference of the ratchet by a spring (not illustrated). The pawl is provided to cooperate with a tooth of the ratchet when the input wheel turns in the anticlockwise direction and to slide against the ratchet when the input wheel turns in the clockwork direction.

The spring barrel 111 is provided in order to drive the ringing wheel work (not illustrated) by means of the toothing of the wheel 139. As already mentioned, the wheel 139 is integral with the shaft of the spring barrel 137. It will be understood that when the spring of the spring barrel is progressively unwound, the shaft of the spring barrel drives the wheel 139 in the anticlockwise direction by transmitting to it a motor torque which is variable as a function of the degree of winding-up of the spring barrel. Furthermore, as the torque which drives the ringing mechanism is variable as a function of the degree of winding-up of the spring barrel, the speed at which the ringing is performed also depends upon the degree of winding-up of the spring of the spring barrel. It will be noted that the wheel 139 effects less than one rotation between the completely wound-up state thereof and the completely unwound state thereof. The magnet 207 is arranged on the wheel 139 such that it does not pass the discontinuity of the edge of the cam when the spring barrel is unwound between the two above-mentioned extreme states.

Winding-up of the spring barrel is effected with the help of the rack 141. The wearer of the watch can actuate the rack manually with the help of a push button (not illustrated) or a slide (not illustrated) which is situated on the watch case. When the wearer of the watch actuates the rack, the latter pivots while driving the input wheel 145 of the one-directional wheel work 143 in the anticlockwise direction. The output wheel of the one-directional wheel work is driven by the entry wheel and itself drives the pinion of the spring barrel 113 which thus causes a little less than one rotation in the clockwise direction, inducing winding up of the spring barrel 113. Then, when the wearer of the watch releases the slide or the push button, a spring (not illustrated) locks the rack in the opposite direction to that of the arrow of FIG. 4. The return travel of the rack has the effect of driving the input wheel 145 of the one-directional wheel work in the clockwise direction. As the one-directional wheel work does not transmit rotations in the clockwise direction, the shaft of the spring barrel is not driven in the opposite direction.

FIG. 5 is a partial perspective view from below of the second embodiment which is likewise the subject of FIGS. 3 and 4. In FIG. 5, some parts, the rack and the wheel 139 thereof, have been omitted so as to make it possible to see the two magnetic elements of the equalisation device according to the invention. In the illustrated example, these two magnetic elements are respectively a magnetic cam 203 and a cylindrical bipolar magnet 207. It can be seen that the illustrated cam is very similar to the magnetic cams 3 and 103 described above. The cam 203 is fitted concentrically on the shaft of the spring barrel and it is fixed on the cover of the spring barrel 135. The bipolar magnet 207, for its part, is mounted on the plate of the wheel 139 at a distance from the axis of rotation in order to be arranged opposite the cam. It is therefore not arranged in the same plane as the cam, as was the case for the first embodiment, but in a plane parallel to that of the cam, above the latter. In this case, the magnet preferably has an axial magnetisation direction (parallel to the axis of rotation of the spring barrel). It will be understood that, in these conditions, the magnetic interaction between the magnet and the cam has a different main direction which is essentially axial. It will be mentioned therefore that the arrangement of the equalisation device is of the axial type here, which has the advantage of generally being more compact than a device of the radial type.

In the ringing mechanism which has just been described, the magnet 207, which is integral with the wheel 139, turns in the same direction as the shaft of the spring barrel 137. In these conditions, the magnet 207 turns in the anticlockwise direction relative to the cam when the spring of the spring barrel 133 is unwound while driving the ringing mechanism. As FIG. 5 shows, the radial width of the cam 203 increases during passage into the anticlockwise direction. In these conditions, the intensity of the magnetic interaction between the magnet and the cam increases with unwinding of the spring of the spring barrel. The magnetic potential which results causes a tangential force on the magnet. Thus the equalisation device which has just been described provides an auxiliary torque which is exerted on the shaft of the spring barrel in the same direction as the motor torque and which increases as the motor torque decreases.

Furthermore, it will be understood that various modifications and/or improvements evident to a person skilled in the art can be applied to the embodiments which are the subject of the present invention without going beyond the scope of the present invention defined by the annexed claims.

What is claimed is:

1. A timepiece movement comprising:

a mechanism;

a spring barrel configured to drive the mechanism by means of a kinematic linkage being configured to exert a driving torque on the mechanism, the spring barrel including a motor spring configured to allow the spring barrel to exert a motor torque; and an equalization device configured to equalize the driving torque, the equalization device being connected kinematically to the spring barrel and driven by the spring barrel, and exerting an auxiliary torque, the auxiliary torque being added to the motor torque and forming the driving torque, the auxiliary torque varying as a function of a degree of winding-up of the motor spring, countering a variation in the motor torque caused by the motor spring, and equalizing the driving torque within a useful range of the degree of winding-up, wherein the equalization device includes a magnetic system including a first magnetic element and a second magnetic element, wherein the first magnetic element is mounted concentrically on a shaft of the spring barrel or is fixed concentrically to a wheel that is connected kinematically to the spring barrel and the first magnetic element forms a magnetic cam having an outer edge with a spiral shape, and wherein when the equalization device is driven by the spring barrel, the first and second magnetic elements being displaced from each other by exerting a magnetic force to each other, the magnetic force varying as a function of a relative position occupied by the first magnetic element and the second magnetic element and produces the auxiliary torque.

2. The timepiece movement according to claim 1, wherein the auxiliary torque exerted by the equalization device is counter to the motor torque.

3. The timepiece movement according to claim 1, wherein said magnetic cam includes a ferromagnetic material.

4. The timepiece movement according to claim 1, wherein the magnetic cam and the second magnetic element form a radial magnetic system.

5. The timepiece movement according to claim 1, wherein the magnetic cam and the second magnetic element form an axial magnetic system.

6. The timepiece movement according to claim 1, wherein the second magnetic element is a bipolar permanent magnet.

7. The timepiece movement according to claim 1, wherein the mechanism driven by the spring barrel is a ringing mechanism.

8. A timepiece movement comprising:

a mechanism;

a spring barrel configured to drive the mechanism by means of a kinematic linkage being configured to exert a driving torque on the mechanism, the spring barrel including a motor spring configured to allow the spring barrel to exert a motor torque; and an equalization device connected kinematically to the spring barrel and driven by the spring barrel and exert an auxiliary torque being added to the motor torque and form together the driving torque, the auxiliary torque varying as a function of a degree of winding-up of the motor spring and counter a variation in the motor torque caused by the motor spring and equalize the driving torque within a useful range of a degree of winding-up, wherein the equalization device includes a magnetic system including a first magnetic element and a second magnetic element, the first and second magnetic elements being displaced from each other by exerting a magnetic force to each other when the equalization device is driven by the spring barrel, the magnetic force varying as a function of a relative position occupied by the first magnetic element and the second magnetic element and produces the auxiliary torque, and an auxiliary reducing wheel work configured to operate in kinematic linkage with the spring barrel, the auxiliary reducing wheel work including a wheel, the wheel bearing the first magnetic element or the second magnetic element and being configured to effect less than one rotation while the spring barrel effects a plurality of rotations between a completely wound-up state of the motor spring and a completely unwound state of the motor spring.

9. The timepiece movement according to claim 8, wherein the equalization device forms at least partially a device for indicating a power reserve.

10. A timepiece movement comprising:

a mechanism;

a spring barrel configured to drive the mechanism by a kinematic linkage being configured to exert a driving torque on the mechanism, the spring barrel including a motor spring configured to allow the spring barrel to exert a motor torque; and an equalization device connected kinematically to the spring barrel and driven by the spring barrel and exert an auxiliary torque being added to the motor torque and form together the driving torque, the auxiliary torque varying as a function of a degree of winding-up of the motor spring and counter a variation in the motor torque caused by the motor spring and equalize the driving torque within a useful range of a degree of winding-up, wherein the equalization device includes a magnetic system including a first magnetic element and a second magnetic element, wherein when the equalization device is driven by the spring barrel, the first and second magnetic elements being displaced from each other by exerting a magnetic force to each other, the magnetic force varying as a function of a relative position occupied by the first magnetic element and the second magnetic element and produces the auxiliary torque, and wherein the motor torque and the auxiliary torque exerted by the equalization device have a same direction.

* * * * *